US009953817B2

(12) United States Patent
Berkout et al.

(10) Patent No.: US 9,953,817 B2
(45) Date of Patent: Apr. 24, 2018

(54) ION TRANSFER TUBE WITH SHEATH GAS FLOW

(71) Applicant: Smiths Detection Inc., Edgewood, MD (US)

(72) Inventors: Vadym Berkout, Rockville, MD (US); Douglas J. Green, Baldwin, MD (US)

(73) Assignee: Smiths Detection Inc., Edgewood, MD (US)

( * ) Notice: Subject to any disclaimer, the term of this patent is extended or adjusted under 35 U.S.C. 154(b) by 0 days.

(21) Appl. No.: 15/136,279

(22) Filed: Apr. 22, 2016

(65) Prior Publication Data

US 2017/0309461 A1 Oct. 26, 2017

(51) Int. Cl.
*H01J 49/10* (2006.01)
*H01J 49/04* (2006.01)

(52) U.S. Cl.
CPC ..... *H01J 49/0404* (2013.01); *H01J 49/10* (2013.01)

(58) Field of Classification Search
USPC ..... 250/282
See application file for complete search history.

(56) References Cited

U.S. PATENT DOCUMENTS 4,885,076 A * 12/1989 Smith ..... G01N 27/4473 204/451
7,081,620 B2 * 7/2006 Kato ..... H01J 49/0404 250/288
8,304,718 B2 * 11/2012 Ouyang ..... H01J 49/0495 250/281
8,592,756 B2 11/2013 Ouyang et al.
2006/0108539 A1 5/2006 Franzen
2008/0067359 A1 3/2008 Musselman
2012/0312979 A1 12/2012 Cooks et al.
2016/0293392 A1 10/2016 Berkout

FOREIGN PATENT DOCUMENTS

WO 2015070352 A1 5/2015

OTHER PUBLICATIONS

Cody, Robert B., Laramee, James A., Durst, H. Dupont, "Versatile New Ion Source for the Analysis of Materials in Open Air under Ambient Conditions", Anal. Chem., 2005, vol. 77, No. 8, pp. 2297-2302.

(Continued)

*Primary Examiner* — Phillip A Johnston
(74) *Attorney, Agent, or Firm* — Advent, LLP

(57) ABSTRACT

An ion transfer tube assembly, a mass spectrometry system, and a method for providing an ion stream to an ion detection device are described that include using an ion transfer tube that provides a coaxial sheath gas flow. In an implementation, an ion transfer tube assembly includes an ion transfer tube for delivering the ion stream, where a sheath gas flows through the ion transfer tube, and where the ion transfer tube receives the ion stream from a first conduit coupled to an ion source; a pump fluidly coupled to the ion transfer tube, where the pump causes the sheath gas to flow through the ion transfer tube, where the ion stream is separated from the ion transfer tube walls by the coaxial sheath gas flow, and where the ion stream is received by a second conduit coupled to the ion detection device.

20 Claims, 3 Drawing Sheets

(56) References Cited

OTHER PUBLICATIONS

Harper, Jason D., Charipar, Nicholas A., Mulligan, Christopher C., Zhang, Xinrong, Cooks, R. Graham, Ouyang, Zheng, "Low-Temperature Plasma Probe for Ambient Description Ionization", Anal. Chem., 2008, vol. 80, No. 23, pp. 9097-9104.

Lin, Baiwei, Sunner, Jan, "Ion Transport by Viscous Gas Flow Through Capillaries", J. Am. Soc. Mass. Spectrom., 1994, 5, pp. 873-885.

Na, N., Zhao, Mengxia, Zhang, Sichun, Yang, Chengdui, Zhang Xinrong et al., "Development of a Dielectric Barrier Discharge Ion Source for Ambient Mass Spectrometry", 2007, vol. 18, Issue 10, pp. 1859-1862.

Takats, Zoltan, Wiseman, Justin M., Gologan, Bogdan, Cooks, R. Graham, "Mass Spectrometry Sampling Under Ambient Conditions with Desorption Electrospray Ionization", Science, 2004, vol. 306, pp. 471-473.

Gao, Liang, Cooks, R. Graham, Ouyang, Zheng, Breaking the Pumping Speed Barrier in Mass Spectrometry: Discontinuous Atmospheric Pressure Interface, Anal. Chem., 2008, 80, pp. 4026-4032 (Abstract Only).

International Search Report and Written Opinion dated Jul. 26, 2017 for PCT/US2017/028776.

* cited by examiner

ION TRANSFER TUBE WITH SHEATH GAS FLOW

BACKGROUND

The present disclosure relates to mass spectrometry and more particularly to remote ionization and ion transfer.

Mass spectrometers (MS) operate in a vacuum and separate ions with respect to mass-to-charge ratio. In embodiments that use a mass spectrometer, a sample, which may be solid, liquid, or gas, is ionized. The ions are separated in a mass analyzer according to mass-to-charge ratio and are detected by a device capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

SUMMARY

An ambient ionization source, an ion transfer tube assembly, a mass spectrometry system, and a method for delivering an ion stream to an ion detection device are described that include using an ion transfer tube that provides a coaxial sheath gas flow. In an implementation, an ion transfer tube assembly that employs example techniques in accordance with the present disclosure includes an ion transfer tube for delivering the ion stream, where a sheath gas flow flows through the ion transfer tube, and where the ion transfer tube receives the ion stream from a first conduit coupled to an ion source; a pump fluidly coupled to the ion transfer tube, where the pump causes the sheath gas to flow through the ion transfer tube, where the ion stream is substantially surrounded by the coaxial sheath gas flow, and where the ion stream is received by a second conduit coupled to the ion detection device.

In an implementation, a mass spectrometry system that employs example techniques in accordance with the present disclosure includes an ion source coupled to a first conduit; an ion detection device coupled to a second conduit; an ion transfer tube, where the ion transfer tube is coupled to the first conduit and the second conduit and delivers an ion stream from the ion source to the ion detection device, where an outlet of the first conduit and an inlet of the second conduit is disposed in the cross-sectional center of the ion transfer tube, and where a sheath gas flows through the ion transfer tube such that the ion stream exits the outlet of the first conduit and is substantially surrounded by the coaxial sheath gas flow; and a pump fluidly coupled to the ion transfer tube, where the pump causes the sheath gas to flow through the ion transfer tube.

In an implementation, a method for providing an ion stream to a mass spectrometry system that employs example techniques in accordance with the present disclosure includes generating the ion stream using an ion source with a first conduit; and providing the ion stream from the ion source with a first conduit to an ion detection device with a second conduit using an ion transfer tube coupled to the first conduit and the second conduit, where an outlet of the first conduit and an inlet of the second conduit is disposed in the cross-sectional center of the ion transfer tube, and where a sheath gas flows through the ion transfer tube such that the ion stream exits the outlet of the first conduit and is substantially surrounded by the coaxial sheath gas flow, and where the ion stream flows into the second conduit.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. The use of the same reference number in different instances in the description and the figures may indicate similar or identical items.

DETAILED DESCRIPTION

Overview

Figure 1:
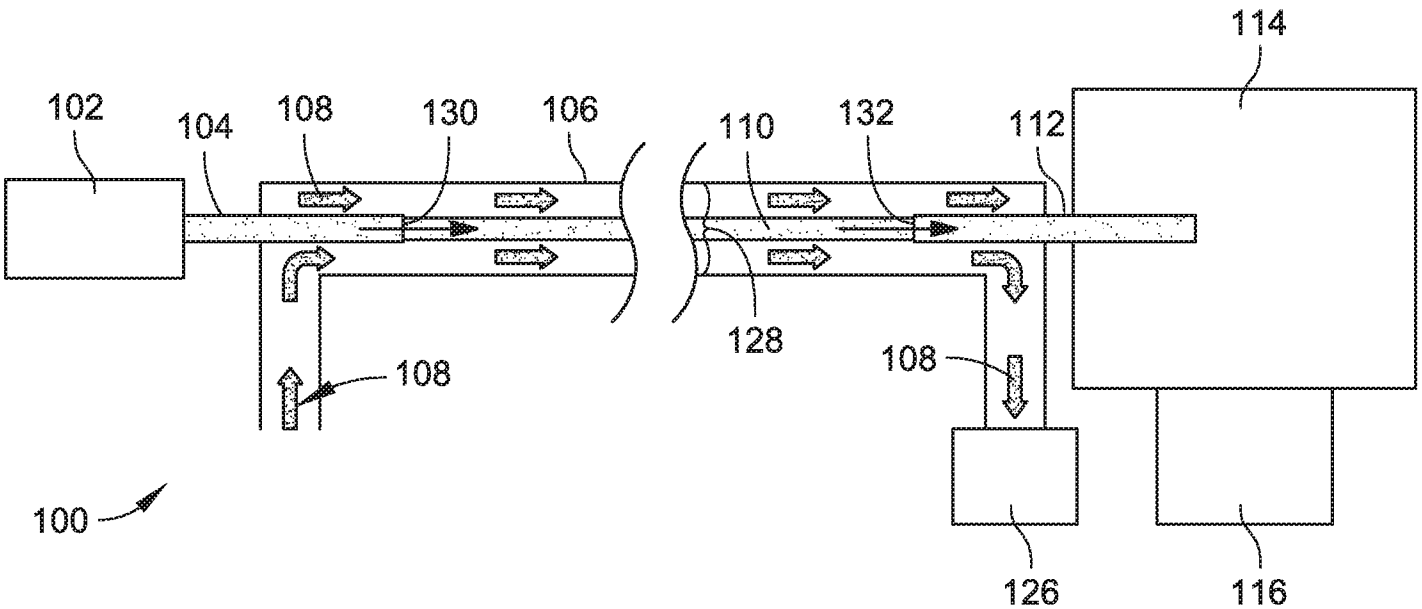
FIG. 1 is a diagrammatic cross-sectional view illustrating an analysis system including an ion transfer tube with coaxial sheath gas flow in accordance with an example implementation of the present disclosure.

Mass spectrometers (MS) operate in a vacuum and separate ions with respect to the mass-to-charge ratio. In some embodiments using a mass spectrometer, a sample, which may be solid, liquid, or gas, is ionized and analyzed. The ions are separated in a mass analyzer according to mass-to-charge ratio and are detected by a detector capable of detecting charged particles. The signal from the detector is then processed into the spectra of the relative abundance of ions as a function of the mass-to-charge ratio. The molecules are identified by correlating the identified masses with known masses or through a characteristic fragmentation pattern.

Ambient ionization methods can be used in an MS or ion-mobility spectrometry (IMS) system to ionize substances for real-time and in situ chemical analysis without any sample preparation. Among them are desorption electrospray ionization (DESI), direct analysis in real-time (DART), low-temperature plasma (LTP), direct atmospheric pressure chemical ionization (DAPCI) and many others. However, the application of ambient ionization for real-life problems is limited by the shortness of the distance from the sample to inlet of ion detection device. Remote sample ionization involves ion transfer to the detection system inlet using flexible tubing. However, ions from the substance which will be analyzed are frequently generated at higher pressure conditions, for example, at atmospheric pressure. A variety of direct ambient ionization methods include desorption electrospray ionization (DESI) (Takats, Z.; Wiseman, J. M.; Gologan, B.; Cooks, R. G. Science 2004, 306, 471-473), direct analysis in real time (DART) (Cody, R. B.; Laramee, J. A.; Durst, H. D. Anal. Chem. 2005, 77, 2297-2302), atmospheric pressure Dielectric Barrier Discharge Ionization (DBDI) (Na, N.; Zhao, M.; Zhang, S.; Yang, C.; Zhang, X., J Am Soc Mass Spectrom 2007, 18, 1859-1862), low-temperature plasma (LTP) (Harper, J. D.; Charipar, N. A.; Mulligan, C. C.; Zhang, X.; Cooks, R. G.; Ouyang, Z., Anal. Chem. 2008, 80, 9097-9104), etc., which are all incorporated herein by reference.

In many instances it is not feasible to place analyzed samples in front of a mass spectrometer inlet. In this case, generated ions need to be transferred over a long distance without significant loss of analyte signal.

There are significant technical challenges for providing efficient transfer of low abundance analyte ions of interest from an ionization source into ion detection system over a long distance, especially in the case of a miniature mass analyzer. The challenges are mainly related to size and weight limitations of portable systems, which severely limit the choice of vacuum pumps that can be used in such systems. Small vacuum pumps limit the intake flows into a mass spectrometer to about 0.15 L/min. The main mechanism of ion losses in long narrow tubing at ion concentration less than $10^8$ $cm^{-3}$ is radial diffusion to the walls (Lin, B.; Sunner, J., Ion transport by viscous gas flow through capillaries, *J Am Soc Mass Spectrom,* 1994, 5, 873-885). The change in ion concentration n with diffusion limited losses can be described by the following equation:

$$n/n_0 = \exp\left(-\frac{D^* t}{r_0^2} 2.405^2\right) \quad \text{Equation 1}$$

where D*=D/1.6 is an effective ion diffusion coefficient (to account for parabolic velocity profile inside the capillary) and t is residence time (See Sunner, J. et al.). The total residence time $t_f$ can be calculated from the value of the intake flow Q and the capillary volume V:

$$t_f = \frac{60\ V}{Q} \quad \text{Equation 2}$$

where factor 60 is derived from the conversion of L/min to L/s. Substituting $t_f$ for t in Equation 1 and using the relation $V=\pi r_0^2$ L, the following equation can be obtained:

$$n/n_0 = \exp\left(-\frac{0.68\ L\ D}{Q}\right) \quad \text{Equation 3}$$

where Q is the intake flow in L/min, D is the tubing diameter, and L is the capillary length in cm. However, as can be calculated from these equations, for a portable mass spectrometer (e.g., Q~0.15 L/min) with remote sampling at L=50 cm and a typical value of diffusion coefficient D=0.04 $cm^2/s$, only 0.01% of ions are transmitted from the ionization source to the mass analyzer.

One way to overcome this problem for remote direct ionization was proposed by R. Graham Cooks et al., in U.S. Pat. No. 8,592,756, which is incorporated herein by reference, where a gas flow, created by an additional pump at the inlet of a mass spectrometer, pulls ions produced by LTP ionization into a transfer tube with a much higher flow rate than intake flow into the MS inlet. This arrangement allows to reduce diffusion ion losses on walls of the transfer tube because of decreased ion residence time. However, in the Cooks et al. arrangement, ions are distributed over the whole internal section of large diameter tube (e.g., 6.0 mm is shown on FIG. 17 of U.S. Pat. No. 8,592,756), which is much bigger than a diameter of mass spectrometer inlet (e.g., 0.25 mm according to Gao et al. Anal. Chem., 2008, 80, 4026-4032) (paragraph 40 of column 11, U.S. Pat. No. 8,592,756). As the ion flow is proportional to a cross-section area, the portion of ions going to the mass spectrometer inlet is about 0.02% (~$(0.25/6.0)^2$) and the rest are swept away by the additional pump, thus significantly reducing the sensitivity and/or accuracy of detection.

Accordingly, an ion transfer tube assembly, a mass spectrometry system, and a method for delivering an ion stream to an ion detection device are described that include using an ion transfer tube with a coaxial sheath gas flow. In an implementation, an ion transfer tube assembly that employs example techniques in accordance with the present disclosure includes an ion transfer tube for delivering the ion stream, where a sheath gas flows through the ion transfer tube, and where the ion transfer tube receives the ion stream from a first conduit coupled to an ion source; a pump fluidly coupled to the ion transfer tube, where the pump causes the sheath gas to flow through the ion transfer tube, where the ion stream is substantially surrounded by the coaxial sheath gas flow, and where the ion stream is received by a second conduit coupled to the ion detection device.

In an implementation, a mass spectrometry system that employs example techniques in accordance with the present disclosure includes an ion source coupled to a first conduit; an ion detection device coupled to a second conduit; an ion transfer tube, where the ion transfer tube is coupled to the first conduit and the second conduit and delivers an ion stream from the ion source to the ion detection device, where an outlet of the first conduit and an inlet of the second conduit is disposed in the cross-sectional center of the ion transfer tube, and where a sheath gas flows through the ion transfer tube such that the ion stream exits the outlet of the first conduit and is substantially surrounded by the coaxial sheath gas flow; and a pump fluidly coupled to the ion transfer tube, where the pump causes the sheath gas to flow through the ion transfer tube.

In an implementation, a method for providing an ion stream to a mass spectrometry system that employs example techniques in accordance with the present disclosure includes generating the ion stream using an ion source with a first conduit; and providing the ion stream from the ion source with a first conduit to an ion detection device with a second conduit using an ion transfer tube coupled to the first conduit and the second conduit, where an outlet of the first conduit and an inlet of the second conduit is disposed in the cross-sectional center of the ion transfer tube, and where a sheath gas flows through the ion transfer tube such that the ion stream exits the outlet of the first conduit and is substantially surrounded by the coaxial sheath gas flow, and where the ion stream flows into the second conduit.

In these implementations, after a short transfer through the first conduit, a coaxial sheath gas flow is introduced, which is created by a high flow pump or compressor. Sample ions from the sample are concentrated in a small central part of the gas transfer flow, and the gas velocity of the flow containing the ions (i.e., the ion stream) is increased hence decreasing residence time of ions in the ion transfer tube and ion losses along the walls of the ion transfer tube. Additionally, the sheath gas separates the ions from the walls, thus eliminating a possible charging of the inner tube surface in the case of nonconductive materials. Because the mass spectrometer inlet (e.g., second conduit) has a small inside diameter (e.g., 0.25-0.75 mm) the ion transfer tube described herein provides better matching of the mass spectrometer inlet with the ion stream diameter than some other technologies.

Example Implementations

Figure 2:
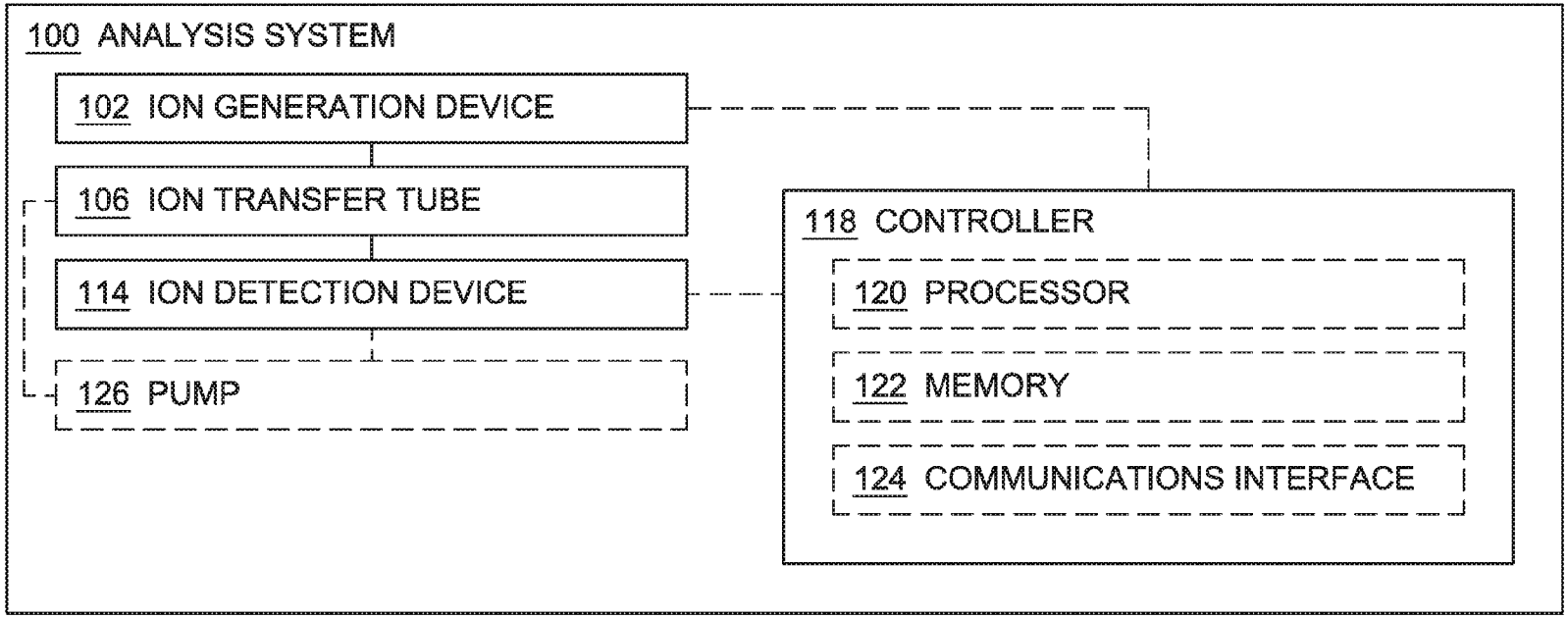
FIG. 2 is a block diagram illustrating an analysis system including an ion transfer tube with coaxial sheath gas flow in accordance with an example implementation of the present disclosure.

FIGS. 1 and 2 illustrate an analysis system 100 and an ion transfer tube 106 in accordance with example implementations of the present disclosure. In implementations, the analysis system 100 may include a mass spectrometry system. As shown, the analysis system 100 can include an ion source 102, an ion transfer tube 106, and an ion detection device 114.

In implementations, the analysis system 100 can include an ion source 102 that provides an ion stream 110 to the ion detection device 114 for analysis. The ion source 102 can receive a substance (e.g., fluid, solid, etc.) and use the substance to produce ions that are indicative of the composition of the substance to be analyzed. Some examples of an ion source 102 may include an electrospray ion source, a sonic spray ionization source, atmospheric pressure matrix-assisted laser desorption/ionization, nano-electrospray ionization, atmospheric pressure chemical ionization, desorption electrospray ionization (DESI), direct analysis in real-time (DART), direct atmospheric pressure chemical ionization (DAPCI), dielectric barrier discharge ionization, low temperature plasma desorption ionization, and electrospray-assisted laser desorption ionization, an inductively-coupled plasma, a spark ion source, a corona discharge ion source, and/or a radioactive ion source (e.g., $^{63}$Ni or $^{241}$Am), etc. In embodiments, the ion source 102 may generate ions from a sample at atmospheric pressure or other pressures (e.g., a reduced pressure, high pressure, etc.).

As shown in FIG. 1, the ion source 102 can be coupled to an ion transfer tube 106 so that an ion stream 110 (e.g., ion beam, air stream with ions, etc.), which can include ions provided by the ion source 102 and carried by a gas (e.g., air), can travel through a first conduit 104 from the ion source 102 to the ion transfer tube 106. In some embodiments, the first conduit 104 may include a capillary tube, which may or may not be heated. In some instances, the first conduit 104 may have a constant diameter (e.g., a planar plate or cylinder). In the implementation shown in FIG. 1, the first conduit 104 can extend from the ion source 102 and into the ion transfer tube 106 such that the ion stream 110 exits a first conduit outlet 130 into the ion transfer tube 106. In this implementation, the first conduit outlet 130 can be disposed in the center of the cross-sectional area of the ion transfer tube 106, where the ion stream 110 can be introduced into the sheath gas flow 108 (e.g., a carrier gas, such as air, argon, nitrogen, etc.). In a specific embodiment, the first conduit 104 has a diameter of between 0.25 mm and 0.75 mm. It is contemplated that the first conduit 104 may have other diameter sizes and/or configurations.

The ion transfer tube 106 can be configured to deliver an ion stream 110 from the ion source 102 to an ion detection device 114 with a coaxial sheath gas flow 128. In some embodiments, the ion transfer tube 106 may include a flexible tube configured to contain a gas flow, such as a polymer flow tube, and may be selected to minimize ion losses. In some other specific embodiments, the ion transfer tube 106 may include other materials suitable for a gas flow, such as glass or metal, and may be conductive or non-conductive.

Additionally, the diameter of the first conduit 104 may be smaller than the diameter of the ion transfer tube 106 in order to facilitate a coaxial sheath gas flow 128. A coaxial sheath gas flow 128 encompasses an ion stream 110 introduced from the first conduit outlet 130 into a sheath gas flow 108 that is pumped through the ion transfer tube 106, where the sheath gas flow 108 separates the ions in the ion stream 110 from the walls of the ion transfer tube 106. The ion stream 110 is concentrated in a central portion of the cross section of the ion transfer tube 106, where the sheath gas flow 108 velocity increases the flow velocity of the ion stream 110. This coaxial sheath gas flow 128 prevents ion losses to the walls of the ion transfer tube 106, decreases residence time of the ions in the ion transfer tube 106, and minimizes possible charging of the inner surface of the ion transfer tube 106.

As illustrated in FIG. 2, a pump 126 can be in fluid communication with the ion transfer tube 106. In implementations, the pump 126 can be configured to pump and/or move the sheath gas flow 108 (e.g., air, a carrier gas, etc.) through the ion transfer tube 106. Some examples of the pump 126 can include a scroll pump, a diaphragm pump, or any pump suitable to provide a gas flow through the ion transfer tube 106. In one embodiment, the pump 126 can be coupled to and/or disposed proximate to an ion detection device 114. In other embodiments, the pump 126 may be disposed in other locations within the analysis system 100 while being coupled to and/or in fluid communication with the ion transfer tube 106. Additionally, the ion transfer tube 106 and/or the pump 126 may include a vent for venting the coaxial sheath gas flow 128 from the ion transfer tube 106 subsequent to sampling of the ion stream 110. In some specific embodiments, a compressor may be used to create the sheath gas flow 108 in the ion transfer tube 106, where the compressor can be coupled to the ion transfer tube 106.

FIGS. 1 and 2 illustrate an ion detection device 114 configured to receive an ion sample from ion stream 110 by way of a second conduit 112. A second conduit inlet 132 may include one end of the second conduit 112 and be disposed in the ion transfer tube 106 and exposed to the ion stream 110 where ions from the ion stream 110 enter the second conduit inlet 132. In some embodiments, the second conduit inlet 132 may be configured to be substantially exposed only to the ion stream 110 and not the sheath gas flow 108 so that a greater and/or more concentrated sample of ions can be collected and more accurately represent an object of interest from which the ions are generated. The ions from the ion stream 110 can then continue from the ion transfer tube 106 and through the second conduit 112 to the ion detection device 114. In one specific implementation, the second conduit 112 and/or the second conduit inlet 132 may generally have the same or similar diameter of the ion stream 110 and/or the first conduit outlet 130. For example, the first conduit outlet 130, the ion stream 110, and the second conduit inlet 132 may have a diameter of about 0.5 mm. It is contemplated that the first conduit outlet 130, the ion stream 110, and/or the second conduit inlet 132 may include other diameters and/or sizes (e.g., between 0.25 mm to 0.75 mm).

In implementations, the ion detection device 114 may include a mass spectrometer that separates ionized masses based on charge to mass ratios and outputs the ionized masses to a detector. Some examples of an ion detection device 114 and/or mass spectrometer include a quadrupole mass analyzer, a time of flight (TOF) mass analyzer, a magnetic sector mass analyzer, an electrostatic sector mass analyzer, a quadrupole ion trap mass analyzer, etc. Some examples of a detector that can be used in the ion detection device 114 and/or mass spectrometer can include an electron multiplier, Faraday cups, and/or ion-to-photon detectors.

Additionally, pump 116 can be coupled to the ion detection device 114 as illustrated in FIG. 1. In implementations, pump 116 can include a high vacuum pump for providing a vacuum within the ion detection device 114. A vacuum, at least partially created by a high vacuum pump, can reduce and/or eliminate ion-molecule collisions within the ion detection device 114 that may otherwise reduce the effectiveness of the mass spectrometer at separating elements based on their mass-to-charge ratios because molecular collisions may significantly alter the trajectories of the molecules or ions involved and result in less ions of a desired mass/charge reaching the detector of the mass spectrometer. In embodiments, the pump 116 can be coupled to a vacuum chamber of the ion detection device 114 that requires a high vacuum (e.g., low pressure). For example, the pump 116 may be coupled to a vacuum chamber of the ion detection device 114 (e.g., requiring approximately $10^{-3}$ Torr). In some implementations, the pump 116 may include, for example, a turbomolecular vacuum pump. In one specific implementation, pump 116 may include a high vacuum pump configured to draw an ion sample from the ion stream 110 into the second conduit 112 and ion detection device 114 at a rate of about 0.15 L/min. It is contemplated that other flow rates may be achieved (e.g., 0.05 L/min, 0.10 L/min, etc.). The vacuum provided by pump 116 can provide the vacuum that draws ions from ion stream 110 into the second conduit 112 and ion detection device 114 during ion injection.

Referring to FIG. 2, the analysis system 100, including some or all components, can operate under computer control. For example, a processor 120 can be included with or in the analysis system 100 and/or controller 118 to control the components and functions of the analysis system 100 described herein using software, firmware, hardware (e.g., fixed logic circuitry), manual processing, or a combination thereof. The terms "controller," "functionality," "service," and "logic" as used herein generally represent software, firmware, hardware, or a combination of software, firmware, or hardware in conjunction with controlling the analysis system 100. In the case of a software implementation, the module, functionality, or logic represents program code that performs specified tasks when executed on a processor (e.g., central processing unit (CPU) or CPUs). The program code can be stored in one or more computer-readable memory devices (e.g., internal memory and/or one or more tangible media), and so on. The structures, functions, approaches, and techniques described herein can be implemented on a variety of commercial computing platforms having a variety of processors.

Illustrated in FIG. 2, the analysis system 100 can be coupled with a controller 118 for controlling the analysis system 100. The controller 118 can include a processor 120, a memory 122, and a communications interface 124. In some embodiments, the controller 118 may be integrated into and/or include an integrated circuit (IC) with a user interface (e.g., controls, a readout, etc.) for the analysis system 100. In other embodiment, the controller 118, processor 120, memory 122, communications interface 124, and/or user interface may be integrated into one system-in-package/module and/or one or more could be separate discrete components in an end system (e.g., analysis system 100).

The processor 120 provides processing functionality for the analysis system 100 and/or controller 118 and can include any number of processors, micro-controllers, or other processing systems, and resident or external memory for storing data and other information accessed or generated by the analysis system 100 and/or controller 118. The processor 120 can execute one or more software programs that implement techniques described herein. The processor 120 is not limited by the materials from which it is formed or the processing mechanisms employed therein and, as such, can be implemented via semiconductor(s) and/or transistors (e.g., using electronic integrated circuit (IC) components), and so forth.

The controller 118 may include a memory 122. The memory 122 can be an example of tangible, computer-readable storage medium that provides storage functionality to store various data associated with operation of the analysis system 100 and/or controller 118, such as software programs and/or code segments, or other data to instruct the processor 120, and possibly other components of the analysis system 100 and/or controller 118, to perform the functionality described herein. Thus, the memory 122 can store data, such as a program of instructions for operating the analysis system 100 (including its components), and so forth. It should be noted that while a single memory 122 is described, a wide variety of types and combinations of memory (e.g., tangible, non-transitory memory) can be employed. The memory 122 can be integral with the processor 120, can comprise stand-alone memory, or can be a combination of both. In specific instances, the memory 122 may include a buffer (e.g., a region of a physical memory storage used to temporarily store data while it is being moved from one place to another) and/or datalog for storing sensor data.

The memory 122 can include, but is not necessarily limited to removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, and so forth. In implementations, the analysis system 100 and/or the memory 122 can include removable integrated circuit card (ICC) memory, such as memory provided by a subscriber identity module (SIM) card, a universal subscriber identity module (USIM) card, a universal integrated circuit card (UICC), and so on.

The controller 118 may include a communications interface 124. The communications interface 124 can be operatively configured to communicate with components of the analysis system 100. For example, the communications interface 124 can be configured to transmit data for storage in the analysis system 100, retrieve data from storage in the analysis system 100, and so forth. The communications interface 124 can also be communicatively coupled with the processor 120 to facilitate data transfer between components of the analysis system 100 and the processor 120 (e.g., for communicating inputs to the processor 120 received from a device communicatively coupled with the analysis system 100 and/or controller 118). It should be noted that while the communications interface 124 is described as a component of an analysis system 100 and/or controller 118, one or more components of the communications interface 124 can be implemented as external components communicatively coupled to the analysis system 100 via a wired and/or wireless connection. The analysis system 100 can also include and/or connect to one or more input/output (I/O) devices (e.g., via the communications interface 124), including, but not necessarily limited to a display, a mouse, a touchpad, a keyboard, and so on.

The communications interface 124 and/or the processor 120 can be configured to communicate with a variety of different networks, including, but not necessarily limited to a wide-area cellular telephone network, such as a 3G cellular network, a 4G cellular network, or a global system for mobile communications (GSM) network; a wireless computer communications network, such as a WiFi network (e.g., a wireless local area network (WLAN) operated using IEEE 802.11 network standards); an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface 124 can be configured to communicate with a single network or multiple networks across different access points.

Generally, any of the functions described herein can be implemented using hardware (e.g., fixed logic circuitry such as integrated circuits), software, firmware, manual processing, and/or a combination thereof. Thus, the blocks discussed in this disclosure generally represent hardware (e.g., fixed logic circuitry such as integrated circuits), software, firmware, or a combination thereof. In the instance of a hardware configuration, the various blocks discussed in the above disclosure may be implemented as integrated circuits along with other functionality. Such integrated circuits may include all of the functions of a given block, system, or circuit, or a portion of the functions of the block, system, or circuit. Further, elements of the blocks, systems, or circuits may be implemented across multiple integrated circuits. Such integrated circuits may comprise various integrated circuits, including, but not necessarily limited to a monolithic integrated circuit, a flip chip integrated circuit, a multichip module integrated circuit, and/or a mixed signal integrated circuit. In the instance of a software implementation, the various blocks discussed in the above disclosure represent executable instructions (e.g., program code) that perform specified tasks when executed on a processor. These executable instructions can be stored in one or more tangible computer readable media. In some such instances, the entire system, block, or circuit may be implemented using its software or firmware equivalent. In other instances, one part of a given system, block, or circuit may be implemented in software or firmware, while other parts are implemented in hardware. In a specific embodiment, an analysis function or other parts and functions of the analysis system 100 can be implemented on a remote system (e.g., a server).

Further, the analysis system 100 and/or the communications interface 124 may include a user interface. In implementations, a user interface can include a device configured to display information to a user. For example, a user interface can include a display screen and/or a touch screen. In one specific embodiment, analysis system 100 and communications interface 124 includes a user interface that further includes a touch screen that is coupled to controller 118 and is configured to present sensor information to a user. In this specific embodiment, the user interface may also receive input from a user and transmit the input to controller 118.

Example Processes

Figure 3:
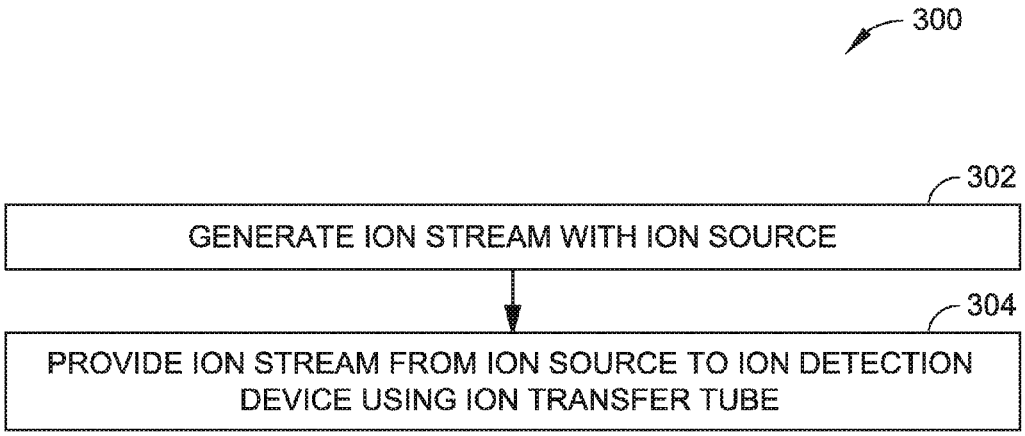
FIG. 3 is a flow diagram illustrating an example process for utilizing the analysis system including an ion transfer tube with coaxial sheath gas flow illustrated in FIGS. 1 and 2.

FIG. 3 illustrates an example process 300 that employs the disclosed techniques to employ an analysis system and/or a mass spectrometer, such as the analysis system 100 and ion detection device 114 shown in FIGS. 1 and 2.

Accordingly, an ion stream is provided using an ion source (Block 302). In implementations, producing an ion stream including a sample of ions can include, for example, using an ion source 102 (e.g., electrospray ionization, inductively-coupled plasma, spark ionization, a corona source, a radioactive source (e.g., 63Ni), etc.) to produce the ions and create a vapor and/or aerosol containing the ions (e.g., ion stream 110), which may subsequently be introduced into first conduit 104 and/or ion transfer tube 106. In one embodiment, producing a sample of ions includes using an ion source 102 including an electrode and a low-temperature plasma ionization process. In another embodiment, providing an ion stream 110 can include using a corona discharge ion source that utilizes a corona discharge surrounding a conductor to produce the sample of ions from an object of interest. In another embodiment, providing an ion stream can include using electrospray ionization that is used to produce the sample of ions. Electrospray ionization may include applying a high voltage to a sample through an electrospray needle, which emits the sample in the form of an aerosol. The aerosol then traverses the space between the electrospray needle and a cone while solvent evaporation occurs, which results in the formation of ions. It is contemplated that providing an ion stream may include using other types of an ion source 102.

Additionally, providing the ion stream may include using the sheath gas flow 108 in the ion transfer tube 106 to provide a vacuum (e.g., a venture configuration) that can pull ions generated from the ion source 102 into the first conduit 104 and into the ion transfer tube 106. It is contemplated that other methods may be utilized to move the ions into the first conduit 104 and/or ion transfer tube 106.

The ion stream is provided to an ion detection device using an ion transfer tube (Block 304). In implementations, providing an ion stream can include using a coaxial sheath gas flow 128 in the ion transfer tube 106 to deliver the ion stream 110 to the ion detection device 114. In these implementations, a sample of ions and/or the ion stream 110 can travel and/or move through the first conduit 104 and exit the first conduit outlet 130 generally into the cross-sectional center of the ion transfer tube 106 and sheath gas flow 108, which results in a coaxial sheath gas flow 128. The coaxial sheath gas flow 128 can include the ion stream 110 generally in the center of and/or away from the walls of the ion transfer tube 106, where the ion stream 110 is cross-sectionally linearly surrounded by the sheath gas flow 108. In a specific embodiment, the sheath gas flow 108, which may be created using a pump 126 disposed proximate to the second conduit 112 and/or the ion detection device 114, can pull ions produced by the ion source 102 into the first conduit 104 and the ion transfer tube 106 with a much higher flow rate than the intake flow of the second conduit 112 and ion detection device 114. The high flow decreases ion residence time within the ion transfer tube 106. This allows a reduction of ion diffusion and ion losses on the walls of the ion transfer tube 106 due to decreased residence time of the ions and ion stream 110 within the ion transfer tube 106 and due to minimal contact of the ion stream 110 with the walls of the ion transfer tube 106. Because the sheath gas flow 108 separates the ions and ion stream 110 from the walls of the ion transfer tube 106, possible charging of the ion transfer tube 106 is avoided when the ion transfer tube 106 includes a nonconductive material.

Once the ion stream 110 and ions enter and/or are drawn into the second conduit 112, the ions may be transported into the ion detection device 114 and/or mass spectrometer and may be analyzed to determine the composition of the object of interest associated with the ions.

Although the invention has been described in language specific to structural features and/or methodological acts, it is to be understood that the invention defined in the appended claims is not necessarily limited to the specific features or acts described. Although various configurations are discussed the apparatus, systems, subsystems, components and so forth can be constructed in a variety of ways without departing from this disclosure. Rather, the specific features and acts are disclosed as example forms of implementing the claimed invention.

What is claimed is:

1. An ion transfer tube assembly for delivering an ion stream to an ion detection device, comprising:

an ion transfer tube for delivering the ion stream, where a sheath gas flows through the ion transfer tube, and where the ion transfer tube receives the ion stream from a first conduit coupled to an ion source; and a pump fluidly coupled to the ion transfer tube, where the pump causes the sheath gas to flow through the ion transfer tube, where the ion stream is separated from the ion transfer tube walls by the coaxial sheath gas flow, and where the ion stream is received by a second conduit coupled to the ion detection device, and where an outlet of the first conduit and an inlet of the second conduit is disposed in the cross-sectional center of the ion transfer tube.

2. The ion transfer tube assembly for delivering an ion stream to an ion detection device in claim 1, where the ion source includes at least one of a desorption electrospray ionization (DESI), a direct analysis in real-time (DART) ionization, a low-temperature plasma (LTP) ionization, or a direct atmospheric pressure chemical ionization (DAPCI).

3. The ion transfer tube assembly for delivering an ion stream to an ion detection device in claim 1, where at least one of the first conduit or the second conduit includes a capillary.

4. The ion transfer tube assembly for delivering an ion stream to an ion detection device in claim 1, where the ion transfer tube includes a conductive polymer.

5. The ion transfer tube assembly for delivering an ion stream to an ion detection device in claim 1, where the ion transfer tube is flexible.

6. The ion transfer tube assembly for delivering an ion stream to an ion detection device in claim 1, where the ion detection device includes a mass spectrometer.

7. The ion transfer tube assembly for delivering an ion stream to an ion detection device in claim 1, where the pump includes at least one of a high flow pump or a compressor.

8. A mass spectrometry system, comprising:

an ion source coupled to a first conduit;

an ion detection device coupled to a second conduit;

an ion transfer tube, where the ion transfer tube is coupled to the first conduit and the second conduit and delivers an ion stream from the ion source to the ion detection device, where an outlet of the first conduit and an inlet of the second conduit is disposed in the cross-sectional center of the ion transfer tube, and where a sheath gas flows through the ion transfer tube such that the ion stream exits the outlet of the first conduit and is separated from the ion transfer tube walls by the coaxial sheath gas flow; and a pump fluidly coupled to the ion transfer tube, where the pump causes the sheath gas to flow through the ion transfer tube.

9. The mass spectrometry system in claim 8, where the ion source includes at least one of a desorption electrospray ionization (DESI) ionization, a direct analysis in real-time (DART) ionization, a low-temperature plasma (LTP) ionization, or a direct atmospheric pressure chemical ionization (DAPCI).

10. The mass spectrometry system in claim 8, where at least one of the first conduit or the second conduit include a capillary.

11. The mass spectrometry system in claim 10, where the capillary includes a heated capillary.

12. The mass spectrometry system in claim 8, where the ion transfer tube includes a conductive polymer.

13. The mass spectrometry system in claim 8, where the ion transfer tube is flexible.

14. The mass spectrometry system in claim 8, where the pump includes at least one of a high flow pump or a compressor.

15. The mass spectrometry system in claim 8, further comprising:

a controller coupled to the ion source and the ion detection device.

16. A method for providing an ion stream to a mass spectrometry system, comprising:

generating the ion stream using an ion source with a first conduit; and providing the ion stream from the ion source with a first conduit to an ion detection device with a second conduit using an ion transfer tube coupled to the first conduit and the second conduit, where an outlet of the first conduit and an inlet of the second conduit is disposed in the cross-sectional center of the ion transfer tube, and where a sheath gas flows through the ion transfer tube such that the ion stream exits the outlet of the first conduit and is separated from the ion transfer tube walls by the a coaxial sheath gas flow, and where the ion stream is received by the second conduit.

17. The method for providing an ion stream to a mass spectrometry system in claim 16, where the ion transfer tube is flexible.

18. The method for providing an ion stream to a mass spectrometry system in claim 16, where the ion transfer tube includes a conductive polymer.

19. The method for providing an ion stream to a mass spectrometry system in claim 16, where the ion source includes at least one of a desorption electrospray ionization (DESI), a direct analysis in real-time (DART) ionization, a low-temperature plasma (LTP) ionization, or a direct atmospheric pressure chemical ionization (DAPCI).

20. The method for providing an ion stream to a mass spectrometry system in claim 16, where at least one of the first conduit or the second conduit include a capillary.

* * * * *